US007160004B2

(12) United States Patent
Peck

(10) Patent No.: US 7,160,004 B2
(45) Date of Patent: Jan. 9, 2007

(54) LED ILLUMINATION DEVICE WITH A SEMICIRCLE-LIKE ILLUMINATION PATTERN

(75) Inventor: John P. Peck, Manasquan, NJ (US)

(73) Assignee: Dialight Corporation, Farmingdale, NJ (US)

( * ) Notice: Subject to any disclaimer, the term of this patent is extended or adjusted under 35 U.S.C. 154(b) by 71 days.

(21) Appl. No.: 11/069,989

(22) Filed: Mar. 3, 2005

(65) Prior Publication Data

US 2006/0198148 A1 Sep. 7, 2006

(51) Int. Cl.
*F21V 5/02* (2006.01)

(52) U.S. Cl. ..... 362/341; 362/346; 362/347; 362/296; 362/297

(58) Field of Classification Search ..... 362/341, 362/346, 347, 296, 297
See application file for complete search history.

(56) References Cited

U.S. PATENT DOCUMENTS 5,800,051 A * 9/1998 Gampe et al. ..... 362/348
2004/0042212 A1* 3/2004 Du et al. ..... 362/296

FOREIGN PATENT DOCUMENTS

JP 2004341067 * 12/2004

* cited by examiner

*Primary Examiner*—Sandra O'Shea
*Assistant Examiner*—Mark Tsidulko
(74) *Attorney, Agent, or Firm*—Oblon, Spivak, McClelland, Maier & Neustadt, P.C.

(57) ABSTRACT

An LED (light emitting diode) illumination device that can generate a non-circular light output illumination intensity pattern. The illumination source including a reflector with a conic or conic-like shape. Further, an LED is positioned at approximately 90° with respect to a central axis of the reflector.

20 Claims, 3 Drawing Sheets

LED ILLUMINATION DEVICE WITH A SEMICIRCLE-LIKE ILLUMINATION PATTERN

BACKGROUND OF THE INVENTION

1. Field of the Invention

The present invention is directed to an LED (light emitting diode) illumination device that creates a semicircle-like shaped illumination/intensity pattern.

2. Background of the Invention

Generally, light sources emit light in a spherical pattern. Light emitting diodes (LEDs) are unique in that they emit light into a hemispherical pattern. Therefore, to utilize an LED as a light source conventionally reflectors are placed in front of an LED.

FIG. 1 shows a background LED illumination device 10 including an LED 1 and a reflector 11. In the background LED illumination device in FIG. 1 the LED 1 and reflector 11 are oriented along the same axis 12, i.e. along a central optical axis 12 of the reflector 11, and the LED 1 points directly out of the reflector 11 along the axis 12.

With the LED illumination device 10 in FIG. 1, wide-angle light is redirected off of the reflector 11 and narrow angle light directly escapes. The result is that the output of the LED illumination device 10 is a narrower and more collimated beam of light. Thereby, with such an LED illumination device 10, a circular-based illumination pattern is created.

SUMMARY OF THE INVENTION

The present inventor recognized that in certain applications, such as in wall-mounted lights, it would be advantageous to create a non-circular pattern to direct light at a floor, and not waste light on a wall, as an example. Other applications may also benefit from creating a non-circular light output illumination/intensity pattern.

Accordingly, one object of the present invention is to provide a novel LED illumination device that can generate a non-circular light output illumination/intensity pattern.

The present invention achieves the above-noted result by providing a novel illumination source including a reflector with a conic or conic-like shape. Further, a light emitting diode (LED) is positioned at approximately 90° with respect to a central axis of the reflector.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 2:
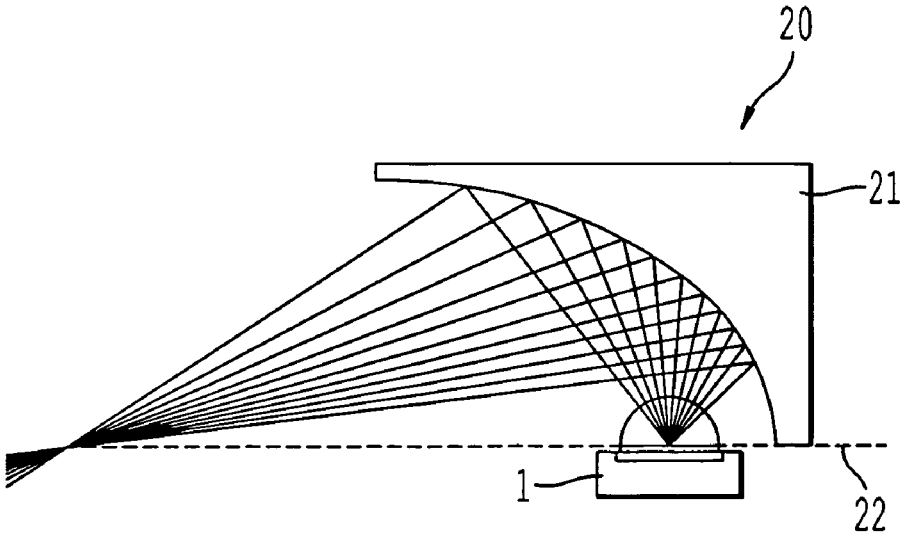
FIG. 2 shows an LED illumination device according to an embodiment of the present invention.

Referring now to the drawings, wherein like reference numerals designate identical or corresponding parts throughout the several views, and more particularly to FIG. 2 thereof, an embodiment of an LED illumination device 20 of the present invention is shown.

As shown in FIG. 2, an LED illumination device 20 of the present invention includes an LED light source 1 and a reflector 21. In the embodiment of the present invention shown in FIG. 2, the LED 1 is rotated approximately 90° off-axis with respect to the reflector 21, i.e. rotated approximately 90° with respect to a central optical axis 22 of the reflector 21. Such an orientation creates an output semicircle based illumination/intensity light pattern.

As noted above with respect to FIG. 1, a background LED illumination device 10 has the LED 1 and the reflector 11 approximately oriented along a same central axis. The result is generation of a circular-based illumination/intensity pattern.

Figure 1:
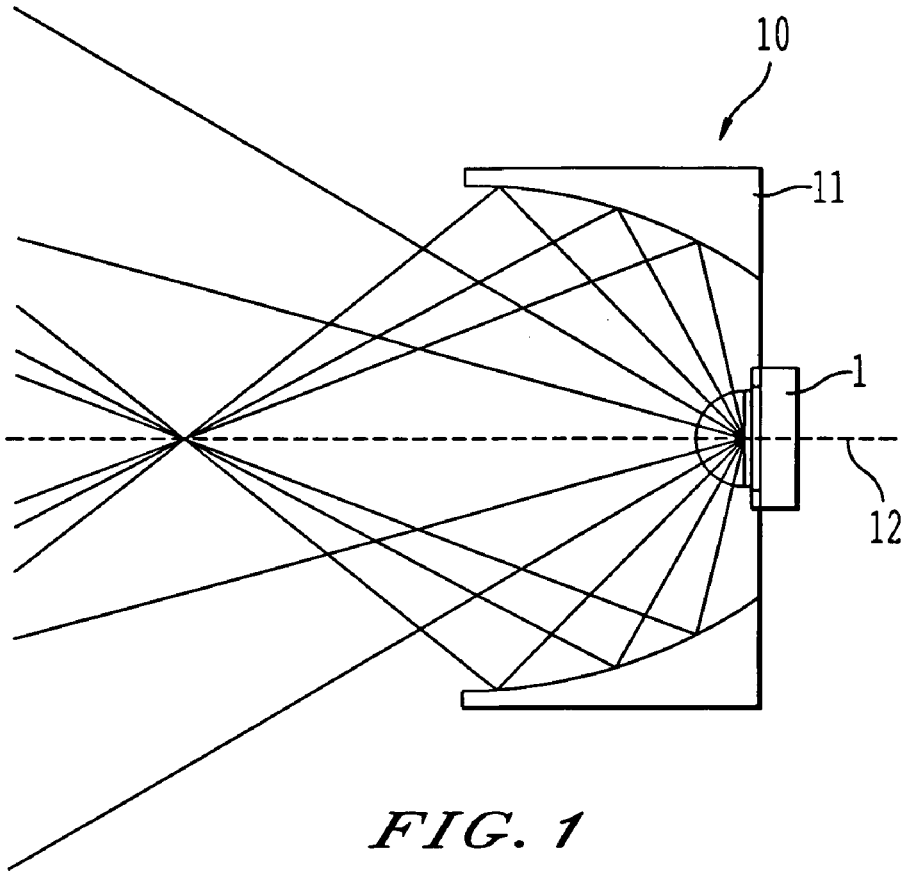
FIG. 1 shows a background art LED illumination device.

In contrast to such a background structure such as in FIG. 1, in the embodiment in FIG. 2 the LED 1 is rotated at approximately 90° with respect to the central axis 22 of the reflector 21 to create a semicircle-based illumination/intensity pattern.

To create the semicircle-like light output intensity pattern, the reflector 21 has a conic or conic-like shape. The reflector 21 can take the shape of any conic including a hyperbola, a parabola, an ellipse, a sphere, or a modified conic.

The reflector 21 may be formed of a typical hollowed reflecting surface. If the reflector 21 is a typical hallowed reflecting surface, it can be formed of a metal, a metalized surface, or another reflectorized surface.

Figure 3:
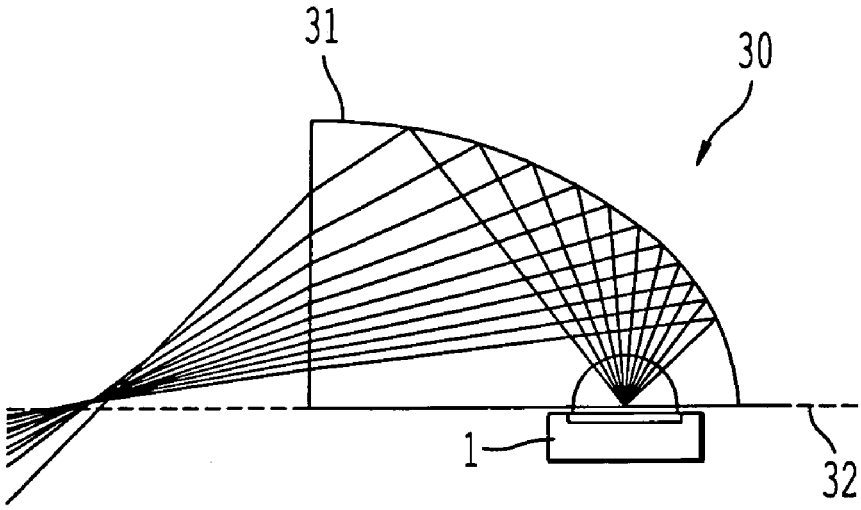
FIG. 3 shows an LED illumination device according to a further embodiment of the present invention.

Or, in a further embodiment of the present invention as shown in FIG. 3, an illumination device 30 can include a reflector 31 made of a solid glass or plastic material that reflects light through total internal reflection, with the LED 1 still offset approximately 90° with respect to the central axis of the reflector 31.

Figure 4:
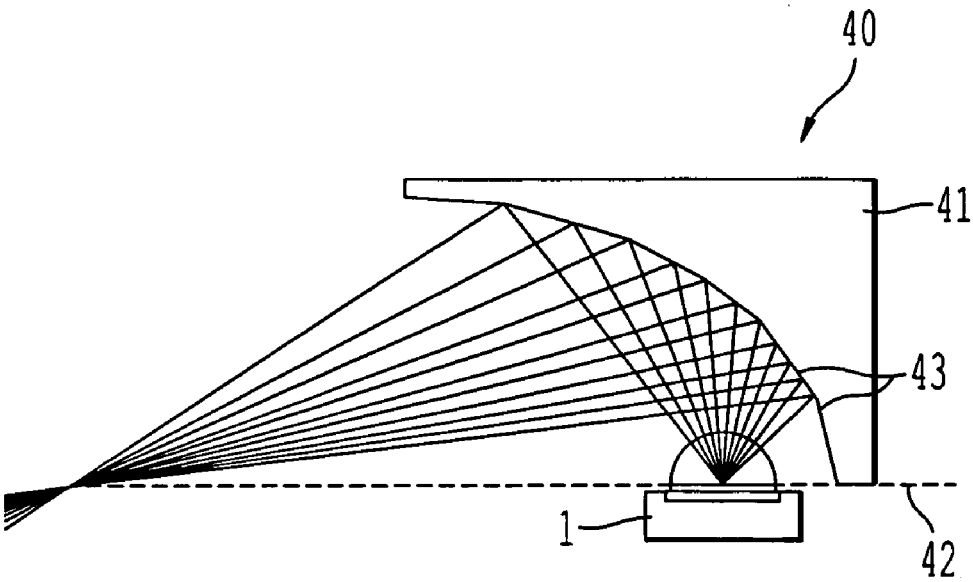
FIG. 4 shows an LED illumination device according to a further embodiment of the present invention.

In a further embodiment of the present invention as shown in FIG. 4, an illumination device 40 can include a reflector 41 with a surface having segmented or faceted conic-reflector surfaces 43. That illumination device 40 still includes an LED 1 offset approximately 90° with respect to the central axis 42 of the reflector 41.

Choosing the specific shape of any of the reflectors 21, 31, 41 can change the illumination/intensity pattern generated by the LED illumination device 20. As noted above, the reflectors 21, 31, 41 each have a conic or conic-like shape to realize a semicircle-based illumination/intensity pattern.

Conic shapes are used commonly in reflectors and are defined by the function:

$$z = \frac{cr^2}{1 + \sqrt{1-(1+k)c^2r^2}} \qquad (1)$$

$$r^2 = x^2 + y^2$$

where x, y, and z are positions on a typical 3-axis system, k is the conic constant, and c is the curvature. Hyperbolas ($k<-1$), parabolas ($k=-1$), ellipses ($-1<k<0$), spheres ($k=0$), and oblate spheres ($k>0$) are all forms of conics. The reflectors, 11, 21 shown in FIG. 1 and FIG. 2 were created using $k=-0.55$ and $c=0.105$. FIG. 2 shows the reflector 21 used in the present embodiments of the present invention. Changing k and c will change the shape of the illumination/intensity pattern. The pattern may thereby sharpen or blur, or may also form more of a donut or 'U' shape, as desired.

One can also modify the basic conic shape by using additional mathematical terms. An example is the following polynomial:

$$z = \frac{cr^2}{1 + \sqrt{1-(1+k)c^2r^2}} + F \tag{2}$$

where F is an arbitrary function, and in the case of an asphere F can equal $$\sum_{n=2}^{10} C_{2n} r^{2n}$$

in which C is a constant.

Conic shapes can also be reproduced/modified using a set of points and a basic curve such as spline fit, which results in a conic-like shape for the reflectors 21, 31, 41.

Thereby, one of ordinary skill in the art will recognize that the desired illumination/intensity pattern output by the illumination devices 20, 30, 40 can be realized by modifications to the shape of the reflector 21, 31, 41 by modifying the above-noted parameters such as in equations (1), (2).

Figure 5:
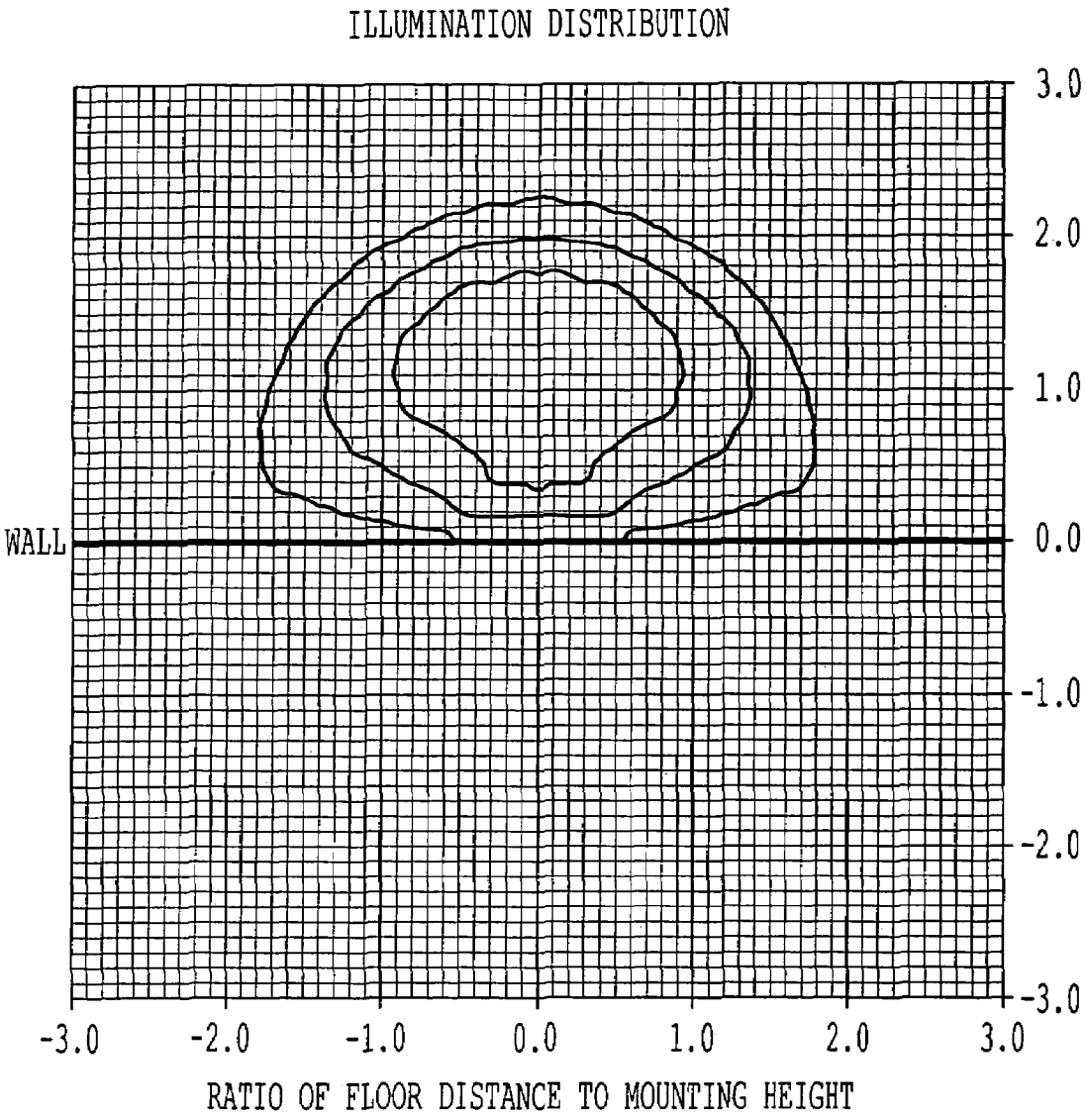
FIG. 5 shows in a chart form an illumination distribution realized by the LED device of FIG. 2.

FIG. 5 shows an example of an output light semicircle shaped illumination distribution for a wall-mounted light using the illumination device 20 of FIG. 2. In FIG. 5 the line 0.0 represents the wall, FIG. 5 showing the illumination distribution with respect to a ratio of floor distance to mounting height. As shown in FIG. 5, a semicircle illumination distribution can be realized by the illumination device 20 such as in FIG. 2 in the present specification, particularly by the reflector 21 satisfying equation (2) above.

Obviously, numerous additional modifications and variations of the present invention are possible in light of the above teachings. It is therefore to be understood that within the scope of the appended claims, the present invention may be practiced otherwise than as specifically described herein.

The invention claimed is:

1. An illumination source comprising:

a reflector with a conic or conic-like shape;

a light-emitting diode LED positioned at approximately 90° with respect to a central axis of the reflector, wherein the reflector satisfies:

$$z = \frac{cr^2}{1 + \sqrt{1-(1+k)c^2r^2}}$$
$$r^2 = x^2 + y^2,$$

in which x, y, and z are positions on a 3-axis system, k is conic constant, and c is curvature.

2. An illumination source according to claim 1, wherein the conic or conic-like shape reflector has a shape selected from the group consisting of: a hyperbola; a parabola; an ellipse; a sphere; or a modified conic.

3. An illumination source according to claim 1, wherein the conic or conic-like shape reflector includes segmented or faceted surfaces.

4. An illumination source according to claim 1, wherein the reflector is formed of one of: a metal; a metalized surface; or a reflectorized surface.

5. An illumination source according to claim 1, wherein the reflector is formed of a solid material of plastic or glass that reflects light through total internal reflection.

6. An illumination source comprising:

means for reflecting light having a conic or conic-like shape;

a light-emitting diode LED positioned at approximately 90° with respect to a central axis of the means for reflecting, wherein the reflector satisfies:

$$z = \frac{cr^2}{1 + \sqrt{1-(1+k)c^2r^2}},$$
$$r^2 = x^2 + y^2$$

in which x, y, and z are positions on a 3-axis system, k is conic constant, and c is curvature.

7. An illumination source according to claim 6, wherein the conic or conic-like shape means for reflecting has a shape selected from the group consisting of: a hyperbola; a parabola; an ellipse; a sphere; or a modified conic.

8. An illumination source according to claim 6, wherein the conic or conic-like shape means for reflecting includes segmented or faceted surfaces.

9. An illumination source according to claim 8, wherein the means for reflecting is formed of one of: a metal; a metalized surface; or a reflectorized surface.

10. An illumination source according to claim 6, wherein the means for reflecting is formed of a solid material of plastic or glass that reflects light through total internal reflection.

11. An illumination source comprising:

a reflector with a conic or conic-like shape;

a light-emitting diode LED positioned at approximately 90° with respect to a central axis of the reflector, wherein the reflector satisfies:

$$z = \frac{cr^2}{1 + \sqrt{1-(1+k)c^2r^2}} + F$$
$$r^2 = x^2 + y^2,$$

in which x, y, and z are positions on a 3-axis system, k is conic constant, c is curvature, and F is an arbitrary function.

12. An illumination source according to claim 11, wherein the conic or conic-like shape reflector has a shape selected from the group consisting of: a hyperbola; a parabola; an ellipse; a sphere; or a modified conic.

13. An illumination source according to claim 11, wherein the conic or conic-like shape reflector includes segmented or faceted surfaces.

14. An illumination source according to claim 11, wherein the reflector is formed of one of: a metal; a metalized surface; or a reflectorized surface.

15. An illumination source according to claim 11, wherein the reflector is formed of a solid material of plastic or glass that reflects light through total internal reflection.

16. An illumination source comprising:

means for reflecting light having a conic or conic-like shape;

a light-emitting diode LED positioned at approximately 90° with respect to a central axis of the means for reflecting, wherein the reflector satisfies:

$$z = \frac{cr^2}{1 + \sqrt{1-(1+k)c^2r^2}} + F$$

$$r^2 = x^2 + y^2,$$

in which x, y, and z are positions on a 3-axis system, k is conic constant, c is curvature, and F is an arbitrary function.

17. An illumination source according to claim 16, wherein the conic or conic-like shape means for reflecting has a shape selected from the group consisting of: a hyperbola; a parabola; an ellipse; a sphere; or a modified conic.

18. An illumination source according to claim 16, wherein the conic or conic-like shape means for reflecting includes segmented or faceted surfaces.

19. An illumination source according to claim 16, wherein the means for reflecting is formed of one of: a metal; a metalized surface; or a reflectorized surface.

20. An illumination source according to claim 16, wherein the means for reflecting is formed of a solid material of plastic or glass that reflects light through total internal reflection.

* * * * *